United States Patent [19]

Fox

[11] Patent Number: 4,843,421

[45] Date of Patent: Jun. 27, 1989

[54] SYSTEM FOR PRIMING THE MAGNETIC BRUSH END SEALS OF COPIER/PRINTER MACHINES

[75] Inventor: Wayne D. Fox, Rochester, N.Y.

[73] Assignee: Xerox Corporation, Stamford, Conn.

[21] Appl. No.: 211,016

[22] Filed: Jun. 24, 1988

[51] Int. Cl.[4] ..... G03G 15/09

[52] U.S. Cl. ..... 355/253; 355/215; 118/658

[58] Field of Search ..... 355/3 DD, 3 R, 15, 14 D; 118/656–658, 653, 652

[56] References Cited

U.S. PATENT DOCUMENTS

| | | | |
|---|---|---|---|
| 3,791,730 | 2/1974 | Sullivan | 355/3 DD |
| 3,906,899 | 9/1975 | Harpavat | 118/637 |
| 3,937,570 | 2/1976 | Hudson | 355/3 DD |
| 4,213,617 | 7/1980 | Salger | 118/658 X |
| 4,564,283 | 1/1986 | Fox et al. | 118/652 X |
| 4,565,435 | 1/1986 | Hart | 355/3 DD |
| 4,580,888 | 4/1986 | Thompson et al. | 355/3 DD |
| 4,596,455 | 6/1986 | Kohyama et al. | 355/3 DD |
| 4,616,919 | 10/1986 | Adley et al. | 355/3 DD |
| 4,676,192 | 6/1987 | Yuge et al. | 118/658 |
| 4,699,495 | 10/1987 | Hilbert | 355/3 DD |

*Primary Examiner*—R. L. Moses

*Attorney, Agent, or Firm*—Frederick E. McMullen

[57] ABSTRACT

Apparatus for priming the magnetic end seals in the developer of a xerographic-based copying or printing machine immediately on startup to quickly establish the seals and prevent initial escape of toner from the developer housing, the apparatus continuing to supply developer material to the end seals while the machine is operating, thereby to prevent seal degradation or loss resulting from use and wear.

4 Claims, 3 Drawing Sheets

SYSTEM FOR PRIMING THE MAGNETIC BRUSH END SEALS OF COPIER/PRINTER MACHINES

The invention relates to xerographic developing systems having magnetic end seals to prevent the escape of toner from the developer housing, and more particularly, to an apparatus for priming the seals at startup and during operation to maintain the seals effective at all times.

Toner leakage from the ends of the developer housing of a xerographic copying or printing machine is usually caused by airborne toner within the developer housing escaping through unsealed areas between the magnetic developing brush and the seal on the magnetic developing brush trimming lip of the developer housing. This escaping toner deposits on the brush trimming lip and from there eventually drops down onto the lower parts of the machine, such as the paper path. Additionally, escaping toner may become airborne and deposit on other adjoining machine parts. The resulting toner contamination causes premature service calls due to copy quality defects observed by the customer or by machine service personnel.

While various sealing configurations and seal types such as foam seals have been proposed, magnetic end seals are typically used today in an effort to prevent this. This type of seal uses magnets located between the sides of the developer housing and the moving developing roll at each end of the roll. When developer material is placed or deposited on the seal magnets, a magnetic sealing brush is established between the magnetic developing brush trimming lip on the developer housing and the developing roll and the developing roll axial end seals. The stationary magnetic sealing created at both ends of the developer housing is designed to contact the moving magnetic developing brush created on the developing roll so that there is a constant interaction between the sealing brushes and the magnetic developing brush. This interaction establishes a continuous 'eddy flow' between the brushes that effectively forms a barrier to the escape of any airborne toner from inside the developer housing, thereby containing the airborne toner within the developer housing.

However, the end sealing brushes must, to be effective, be established or formed in some way on the magnets. Loading the developer material by hand is very tedious and may not yield an adequate brush for effective sealing. Further, the end sealing brushes must be established immediately on start up of the machine if the escape of toner is to be prevented at that time. And because the interaction between the moving brush on the developing roll and the stationary sealing brushes can degrade and deplete the sealing brushes, the effectiveness of the magnetic sealing brushes can deteriorate or even fail during operation of the developing system.

In the prior art, U.S. Pat. No. 4,596,455 to Kohyama et al discloses a developing apparatus of the type in which end seal magnets are used in conjunction with magnetic particles to establish a seal intended to prevent toner from leaking out of the developer system. Other prior art patents disclose various developer systems. One U.S. Pat. No. 4,699,495 to Hilbert, discloses a developer system in which the metering slot for controlling the flow of developer material to the mag brush has a gate for selectively opening and closing the slot. Another, U.S. Pat. No. 4,676,192 to Yuge et al, discloses a developer system in which a toner replenishing tank is used to supply toner with an arrangement designed to prevent undesirable diffusing of the carrier by the toner in the tank. And, U.S. Pat. No. 4,565,435 to Hart, discloses an electrostatic copying or printing machine having a developer apparatus of the type adapted to be used with the present invention.

In contrast, the present invention provides a copying or printing apparatus, comprising in combination: a movable photoconductive member on which latent electrostatic images are created for copying or printing; a housing having a sump for holding a supply of developing material for developing the latent electrostatic images created on the photoconductive member; a magnetic brush developer roll in the housing providing a magnetic developing brush in operative developing relation with the photoconductive member; a movable mixing and loading wheel in the housing for mixing the developing material in the sump and loading the developing material onto the developer roll to form the magnetic developing brush; a magnet mounted in the housing adjacent each end of the developer roll, the magnets providing a developer brush forming surface in opposing spaced relation to the developer roll effective upon the application of the developing material thereto to form a magnetic sealing brush for sealing the space between the developer roll and the housing adjacent the developer roll ends; and priming means effective on startup of the apparatus to draw developing material from the sump for supply to the magnets in order to promptly form magnetic sealing brushes on the magnet surfaces to thereby seal the developer housing against leakage, the priming means continuing to draw developing material from the sump for supply to the magnet surfaces as the apparatus is operating thereby to prevent loss or degradation of the sealing brushes during operation of the apparatus.

IN THE DRAWINGS

Figure 1:
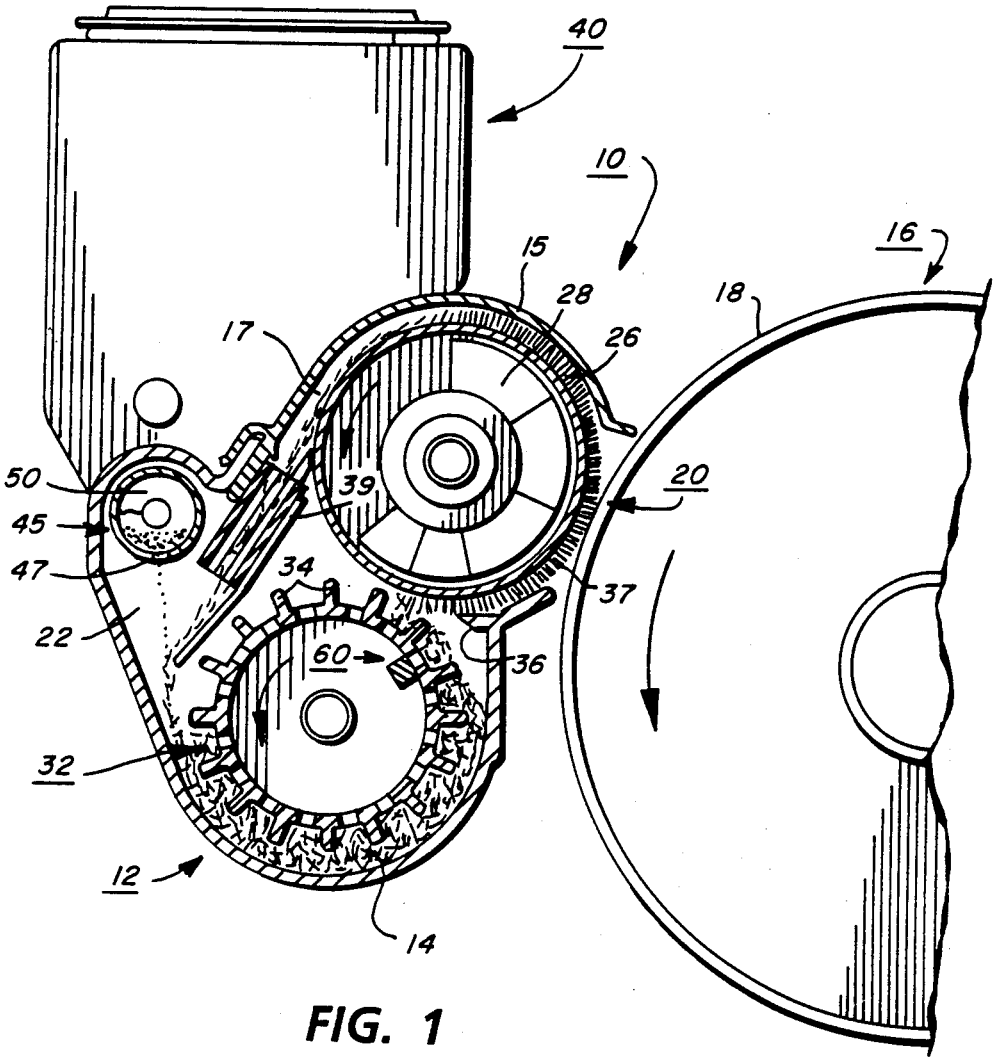
FIG. 1 is a side view partially in section showing details of a developing system incorporating magnetic end seals.

Referring to FIG. 1 of the drawings, there is shown an exemplary developing system, designated generally by the numeral 10, for a xerographic type copying or printing machine having magnetic end seals to prevent the escape of toner from the developing system to other adjacent parts of the machine. The developing systems 10 has a developer housing 12 with a sump 14 within which a developer mixture, typically composed of relatively larger carrier beads and relatively smaller ink particles or toner, resides. Developer housing 12 is suitable supported in predetermined operative relation with the machine photoconductive member, exemplified by a drum 16 having a photoconductive surface 18. Drum 16 is rotated in the direction shown by the solid line arrow in FIG. 1 by suitable drive means (not shown).

as will be understood by those skilled in the xerographic arts, during operation of the copying or printing machine, the photoconductive surface 18 of drum 16 is uniformly charged and thereafter exposed to create a latent electrostatic image. The latent electrostatic image is thereafter carried on drum 16 past developing system 10 where the image is developed. The developed image is thereafter transferred to a copy sheet brought forward from a suitable copy sheet supplied in registered relation with the developed image. The unfused image transferred to the copy sheet is thereafter fixed or fused to provide a permanent copy. Following transfer, the photoconductive surface 18 of drum 16 is cleaned to remove any leftover developer materials preparatory to charging.

A magnetic brush type developing roll 20 is rotatably journaled in the opposite sides 22 (seen in FIG. 3) of developer housing 12 in predetermined spaced operative relation with the photoconductive surface 18 of drum 16, the axis of developing roll 20 being parallel to the the axis of rotation of drum 16. Developing roll 20 has an outer rotatable hollow sleeve or cylinder 26 of a suitable non-magnetic material such as aluminum with a stationary array of magnets 28 disposed therewithin, the polarity and angular disposition of magnets 28 being chosen to cause developer to be attracted to the surface of sleeve 26 and carried thereon into developing relation with the photoconductive surface 18.

A cylindrical paddle wheel 32 having a plurality of vanes or paddles 34 about the periphery is located below developing roll 20. Shaft 35 of wheel 32 is rotatably journaled in sides 22 of developer housing 12 such that the paths of rotation of sleeve 26 of developing roll 20 and paddle wheel 32 are in closely spaced opposing relation with one another. The axis of paddle wheel 32 is parallel with the axis of drum 16 and developing roll 20. Paddle wheel 32 is located in developer ,housing 12 such that paddle 34 pass or sweep through sump 14 and the developer mixture therein to carry developer therefrom into proximity with sleeve 26 of developing roll 20, the magnetic force produced by magnets 28 drawing developer carried by paddles 34 to the outer surface of sleeve 26 to load developer onto the developing roll sleeve 26.

A bar-like wiper 36 is provided on developer housing 12 downstream of the point where developer is loaded onto sleeve 26 of developing roll 20, the leading edge of wiper 34 being in predetermined spaced relation with the surface of sleeve 26 to remove excess developer and provide a brush-like developer covering 37 of preset thickness on sleeve 26. Developing roll 20 and paddle wheel 32 are rotated by suitable means (not shown) in the direction shown by the solid line arrows.

Following movement of the developer brush 37 created on the surface of sleeve 26 of developing roll 20 into operative relation with the photoconductive surface 18 of drum 16, the continued rotation of sleeve 26 carries the developer away from drum 16. As the developer supporting area of sleeve 26 comes opposite the point of no magnetic force, the developer falls by gravity back into sump 14. A suitable cross-mixing baffle 39 extends across the width of developer housing 12 in the path of the returning developer, baffle 39 serving to intermix the carrier and toner particles passing back into sump 14 to assure a uniform developer mixture.

Toner is supplied to developer housing 12 from a toner dispensing hopper 40 disposed on one side of developer housing 12. An auger type agitator in the bottom of hopper 40 (not shown) forces toner therein transversely along the hopper to a toner discharge opening in the side of hopper 40 facing developer housing 12 and into a hollow toner dispensing tube 45 which extends transversely across the upper side or top of housing 12. Dispensing tube 45 has a succession of openings or apertures 47 therein connecting tube 45 with the interior of developer housing 12 to allow metered amounts of toner to pass from tube 45 into sump 14. A rotatable toner transporting auger 50 extends through the interior of dispensing tube 45, auger 50 when rotated carrying toner from hopper 40 transversely along the length of toner dispensing tube 45 for discharge into developer housing 12. Auger 50 is rotated by suitable drive means (not shown) periodically on a demand for toner.

Figure 2:
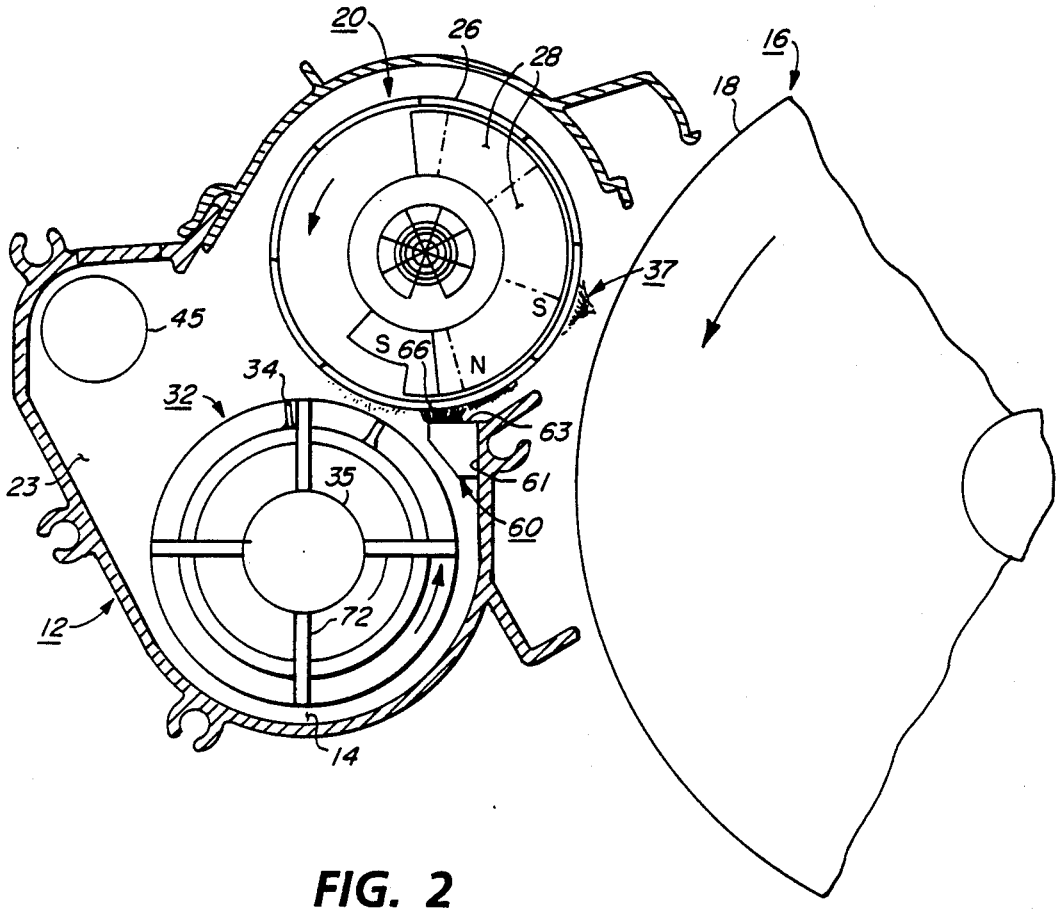
FIG. 2 is a side view partially in section of the developing system in FIG. 1 illustrating the end seal priming system of the present invention.
Figure 3:
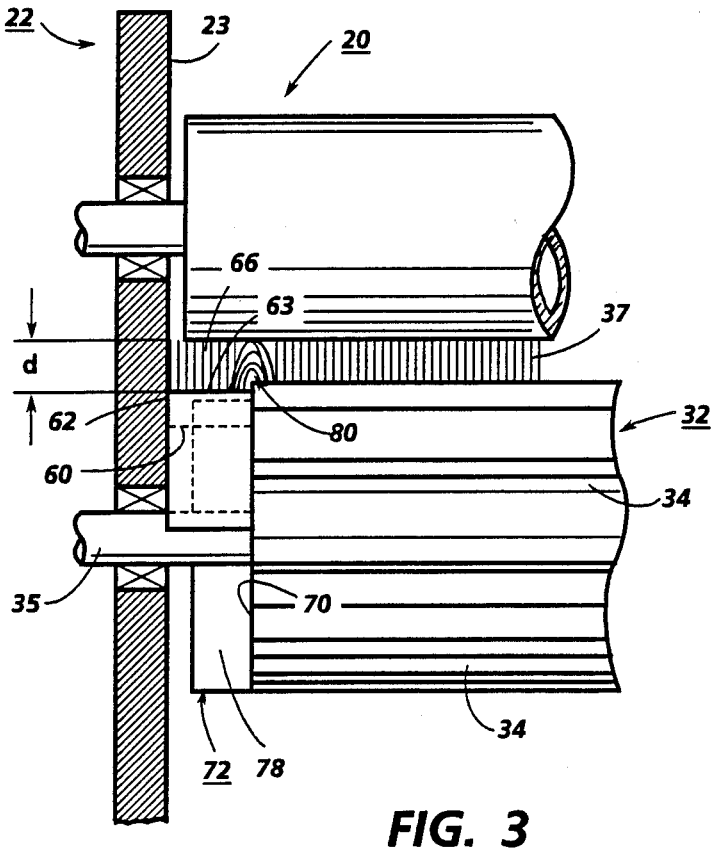
FIG. 3 is an enlarged front view in cross section showing details of the developer loading ribs used to prime the magnetic end seals.

Referring now to FIGS. 2 and 3, to prevent toner leakage from the area adjacent the ends of developer housing 12, a sealing brush is created whenever developing system 10 is actuated. For this purpose, an end seal magnet 60 is mounted in developer housing 12 adjacent each end of developing roll 20, magnets 60 spanning the space between the ends of developing roll 20 and the interior wall 23 of the developer housing sides 22. Magnets 60 have a generally trapezoidal shape with side 61 suitably secured to the inside wall of housing 12 adjacent the opening provided in housing 12 for developing roll 20. The adjoining side 62 of magnets 60 abuts tightly against the interior wall 23 of the developer housing sides 22. Magnets 60 are mounted in developer housing 12 so that the magnet upper surface, i.e. the brush forming surface 63, faces and is spaced a predetermined distance d below developing roll 20. The magnetic strength of magnets 60 is chosen to create on surfaces 63, for the developer mixture used, a sealing brush 66 having a thickness substantially equal to or slightly greater than the distance d during operation of developing system 10.

During operation of developing system 10, a stationary magnetic sealing brush 66 is established on the surfaces 63 of magnets 60 which seals or blocks the gap between trim wiper 36 and developing roll 20 at the roll ends. The magnetic sealing brush 66 established by magnets 60 is of a width sufficient to span the distance between the interior wall 23 of sides 22 and the moving developer brush 37 on developing roll 20. The resulting interaction between the moving brush 37 and the stationary sealing brush 66 does not result in developer material being thrown or ejected from developer housing 12 but instead forms a continuous 'eddy flow' 80 between brushes 37, 66 that cooperates to form an impervious barrier to the escape of airborne toner from inside the developer housing 12 to the outside.

However, magnetic sealing brush 66 must be formed promptly at start up of the developing system, and be continuously maintained at the proper level while the developing system 10 is operating in order to have an effective seal. With sealing brushes of the type described, toner leakage has been found to occur between the time the machine is first started and the brush 66 formed. Also, toner leakage has been found to occur during operation of developing system 10 where interaction between the moving developer brush 37 on developing roll 20 and the stationary sealing brushes 66 on magnets 60 reduces or degrades brushes 66.

To obviate the above, the present invention provides an end seal priming system for priming magnets 60 at the time developing system 10 is started to assure substantially instantaneous creation of sealing brushes 66 on the surfaces 63 of magnets 60. Further, the priming system of the present invention continues to supply developer to the end seal magnets 60 at all times when the developing system 10 is operating, thereby preventing degradation or reduction of the sealing brushes and assuring maintenance of an effective seal at all times.

For this purpose, as shown in FIGS. 2 and 3, there is provided, at ends 70 of paddle wheel 32, a series of developer loading ribs 72. Ribs 72 radiate outwardly from shaft 35 of paddle wheel 32. The length and width of ribs 72 are chosen to provide a developer loading surface 78 of sufficient size to assure that an amount of developer is picked up each time ribs 72 pass through developer sump 14 to substantially fully load or replenish magnet surfaces 63 each time a rib 72 comes into magnetic proximity with magnets 60. At the same time, ribs 72 allow for the unobstructed rotation of paddle wheel 32 in housing 12.

OPERATION

At start up of developing system 10 and rotation of developer roll 30 and paddle wheel 32, developer gathered by the first developer loading rib 72 to pass adjacent the surfaces 63 of magnets 60 is drawn to the surfaces 63 by the magnetic field generated by magnets 60 to immediately form sealing brushes 60 at each end of developer housing 12. The developer, due to the magnetic force field of magnets 60, aligns along a N-S axis on the magnet surfaces 63. The sealing brushes 66 formed are of a height and width sufficient to effectively seal or close off the space or gap between developing roll 20 and the wiper bar 36 at first movement of developing roll 20 and paddle wheel 32 to prevent toner from escaping from housing 12 during start up of developing system 10.

Thereafter, as developing system 10 operates, developer loading ribs 72 continuously bring measured amounts of developer into proximity with magnets 60, allowing any developer lost or removed from the sealing brushes during operation of developing system 10 to be immediately replaced. As a result, maintenance of sealing brushes 66 at the desired size and density to form an effective seal that prevents the escape of toner from housing 12 is provided during operation of developing system 10.

While four developer loading ribs 72 are illustrated, the number of developer loading ribs may be varied from one to any desired number.

While the invention has been described with reference to the structure disclosed, it is not confined to the details set forth, but is intended to cover such modifications or changes as may come within the scope of the following claims.

I claim:

1. In a copying or printing apparatus, the combination of:

(a) a movable photoconductive member on which latent electrostatic images are created for copying or printing;

(b) a housing having a sump for holding a supply of developing material for developing the latent electrostatic images created on said photoconductive member;

(c) a magnetic brush developer roll in said housing providing a magnetic developing brush in operative developing relation with said photoconductive member;

(d) a movable mixing and loading wheel in said housing for mixing said developing material in said sump and loading said developing material onto said developer roll to form said magnetic developing brush;

(e) said housing including a magnet adjacent each end of said developer roll, each of said magnets providing a brush forming surface in opposing spaced relation to said developer roll effective upon the application of developing material thereto to form a magnetic sealing brush for sealing the space between said developer roll and said housing adjacent said developer roll ends; and (f) priming means effective on startup of said apparatus to draw developing material from said sump and supply said developing material to said brush forming surfaces whereby to promptly form said magnetic sealing brushes at each end of said developer roll to seal said developer housing against leakage, said priming means continuing to draw developing material from said sump and supply said developing material to said brush forming surfaces while said apparatus is operating whereby to prevent loss or degradation of said magnetic sealing brushes during operation of said apparatus.

2. The apparatus according to claim 1 in which said priming means comprises a plurality of loading ribs projecting from each end of said mixing and loading wheel for bringing developing material from said sump to said brush forming surfaces.

3. In a copying or printing apparatus, the combination of:

(a) a movable photoconductive member on which latent electrostatic images are created for copying or printing;

(b) a housing having a sump for holding a supply of developing material for developing the latent electrostatic images created on said photoconductive member;

(c) a magnetic brush developer roll in said housing providing a magnetic developing brush in operative developing relation with said photoconductive member;

(d) said developer housing including a magnet adjoining the ends of said developer roll, said magnets providing a developer brush surface in opposing spaced relation to said developer roll exterior effective upon the application of developing material thereto to form a magnetic seal for sealing the space between said developer roll and said housing adjacent said developer roll ends;

(e) first developer loading means in said housing for loading said developing material from said sump onto said magnetic brush developing roll to form said developing brush; and (f) second developer loading means for loading developing material from said sump onto said developer brush surfaces at startup of said apparatus whereby to quickly establish said magnetic seals and seal said developer housing against loss of developing material.

4. The apparatus according to claim 3 in which said second developer loading means continues to supply developing material from said sump to said developer brush surfaces during operation of said apparatus whereby to maintain said magnetic sealing brushes effective and replenish developing material lost during machine operation.

* * * * *